United States Patent [19]

Mougin

[11] 4,200,409

[45] Apr. 29, 1980

[54] PROTECTIVE SIDE WALL FOR TABULAR ICEBERGS

[75] Inventor: Georges L. Mougin, Paris, France

[73] Assignee: ITI Limited, Paris, France

[21] Appl. No.: 899,250

[22] Filed: Apr. 24, 1978

[30] Foreign Application Priority Data

Apr. 22, 1977 [FR] France ..... 77 12179

[51] Int. Cl.[2] ..... E02B 1/00

[52] U.S. Cl. ..... 405/52; 405/61; 405/211

[58] Field of Search ..... 61/1 R, 1 F, 5, 102; 405/52, 60, 61, 211

[56] References Cited

U.S. PATENT DOCUMENTS

| | | | |
|---|---|---|---|
| 3,289,415 | 12/1966 | Merrill | 61/1 R |
| 3,581,505 | 6/1971 | Liddell | 405/211 |
| 3,599,434 | 8/1971 | Missud | 61/5 X |
| 3,906,732 | 9/1975 | Tedeschi | 61/1 F |

OTHER PUBLICATIONS

Ocean Industry, Mar. 1973, pp. 28–29.

*Primary Examiner*—David H. Corbin
*Attorney, Agent, or Firm*—George E. Kersey

[57] ABSTRACT

A vertical wall is placed next to the flank of an iceberg to retain a vertical layer of trapped water in contact with the iceberg. Zig-zag tubes are threaded through the wall at intervals so that the "elbows" in the zig-zags engage the iceberg flank to keep a fixed distance off.

7 Claims, 9 Drawing Figures

Fig. 6
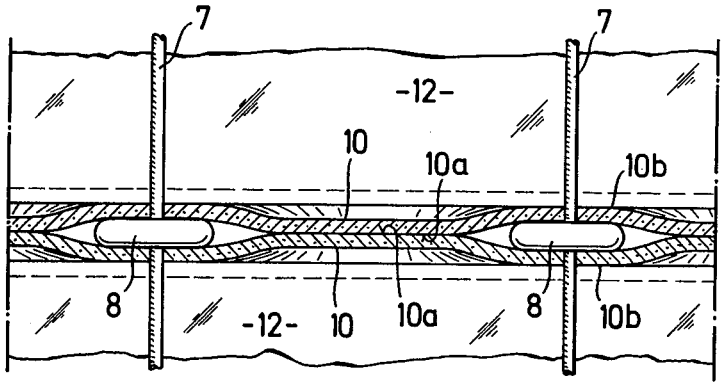
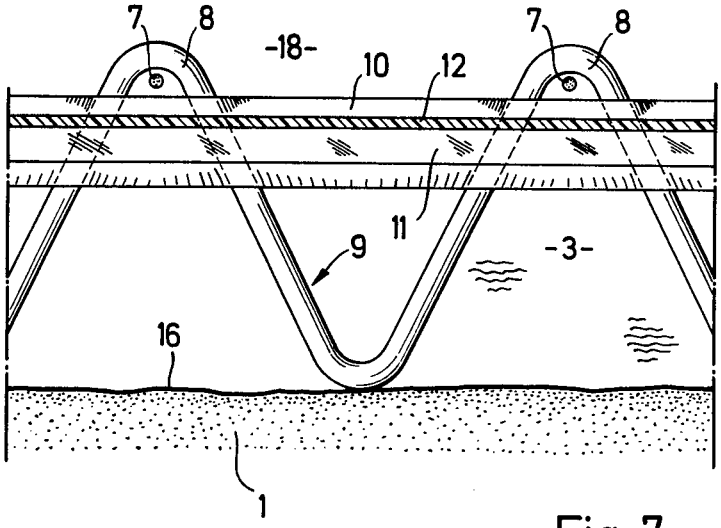
Fig. 7

PROTECTIVE SIDE WALL FOR TABULAR ICEBERGS

The present invention relates to protective side walls for tabular icebergs which originate exclusively in Antarctic waters. In this regions, the ice advances in the form of a plateau with a well defined frontier where it meets the sea, rather than in the form of ice tongues. The Antarctic continent is not surrounded by mountains, but is ringed by a rim of ice, part of which is supported on the continental shelf and the rest of which floats on the sea. Under the pressure of the ice inland, the rim of ice is slowly pushed towards the sea, and from time to time tabular icebergs become detached from it. These can have very large dimensions, covering an area of the order of several square kilometers, and can be towed to the offshore waters of the dry regions of the two hemispheres. However, as the journey at a speed of 0.5 meters per second from the Antarctic to the northern hemisphere lasts several months, it calls for the protection of a vertical strip extending above and below the waterline against the effects of the erosion caused by movements of the sea's surface, and the thermal insulation of the submerged parts. This protection is particularly necessary when the tabular iceberg passes through the warm seas of the tropical zone. The protection of the sides of the tabular icebergs requires the use of units of very large dimensions, for example 200 to 300 meters in height by several hundred meters in length.

It is well known that the movement of waves or of the swell can reach 15 meters above the waterline in calm waters and that water splashes can reach about thirty meters over the waterline. Consequently, it is advisable to seek to avoid continuous friction of the side wall of the tabular iceberg against the vertical faces of the protective wall by keeping the wall a certain distance away. Additionally, thermal insulation of the ice of the iceberg in warm sea-water can be suitably provided by forming areas of unrenewed calm water in the vicinity of the vertical faces of the iceberg, by means of the protective wall, so that the movement of the surface of the warm sea takes place outside the protective wall. This insulation can consist of one or two vertical layers of calm water. To form a first layer of unrenewed calm water in the vicinity of the iceberg's vertical faces, the protective wall needs to be kept a certain distance away from the iceberg's vertical faces. To form one or more additional layers of calm water, protective walls can be made with two or more sheets consisting of vertical panels parallel to the vertical face of the tabular iceberg. Additionally, an extra protection against the mechanical effect of the swell or of the waves can be obtained by placing a "mechanical" protective wall in front of the "thermal" protective wall. It should be noted, however, that if a space is maintained between the protective wall and the iceberg's vertical faces, this has the effect of protecting the iceberg at least partly against the mechanical effect of the waves, as well as insulating it thermally.

The invention is intended to provide a way of keeping the protective wall at a certain distance by means of zig-zag spacing tubes or sections which can be made according to known processes that are outside the scope of the present invention. To this end, the zig-zag spacing tubes are inserted between two strips connecting the vertical panels which form the protective wall. These flat connecting strips can be fastened close together between the zig-zag spacing tubes or can be provided with flotation units, consisting, for example, of expanded foam, in order to maintain a constant spacing of the connecting strips in spite of the presence of the zig-zag spacing tubes.

Protective walls in accordance with the invention offer the advantage of being recoverable. Their installation around a tabular iceberg calls for their transfer to the place of use, i.e. the Antarctic seas, from their place of manufacture, which is a coastal shipyard. Wound around a floating storage and transport drum as they are made, the protective walls for tabular icebergs are set in position by means of the suspension cables used to hold the protective walls around the iceberg. If the protective walls are folded concertinawise when they are made, this aids their installation around the tabular icebergs and also their recovery.

The protective side walls for tabular icebergs in accordance with the present invention provide at least one vertical layer of calm water between the walls and the vertical face of the iceberg. Such protective walls comprise panels parallel to the vertical side face of the tabular iceberg, the width of said panels being greater than their height, and said panels being joined to one another by horizontal connecting strips, tensioned by a ballast positioned at the lower edge of the lower panel, and separately suspended from suspension cables attached to the substantially horizontal upper surface of the tabular iceberg. Thus, the vertical panels are parallel to the vertical side face of the tabular iceberg.

According to a first embodiment of the invention, some of the horizontal zig-zag spacing tubes inserted between two connecting strips bear on the vertical side face of the iceberg in order to keep the vertical panels at a substantially constant distance from the vertical side face of the iceberg. This has the effect of creating a layer of calm water between the protective wall and the vertical side face. Suspension cables joined directly or indirectly to the substantially horizontal upper surface of the tabular iceberg and to some of the elbow-shaped bends in the zig-zag spacing tubes positioned on the side of the protective wall opposite to the vertical side face of the iceberg prevent the protective wall from sinking. Naturally, the dimensions of the tabular icebergs make it necessary to use not just one zig zag spacing tube but rows of zig-zag spacing tubes placed end to end. It should be noted that every second horizontal row of zig-zag spacing tubes is joined to suspension cables so as to permit the recovery of the protective wall. The sides of the panels are secured to the horizontal connecting strips. The sides of the parallel panels, which are positioned at equal distances from the ballast, are secured to the same connecting strips.

According to a second embodiment of the invention, a protective wall comprises an upper part and a lower part. The upper part includes at least two sheets each composed of parallel vertical panels whose sides are secured to horizontal connecting strips. The lower part includes a single sheet consisting of parallel vertical panels whose sides are secured to horizontal connecting strips. The horizontal connecting strips are wrapped around zig-zag spacing tubes, some of the elbows of which are supported against the vertical side face of the tabular iceberg, providing between the protective wall and the vertical side face of the iceberg an additional vertical layer of calm water enclosed between the vertical panels.

Protective walls can be made which comprise, for example, three panels, then two panels, and finally a single panel, so as to obtain a thermal protection corresponding sufficiently accurately to the temperature gradient of the sea water.

In all the embodiments of the invention described above, buoyancy units consisting, for example, of blocks of expanded foam can be inserted between the connecting strips wrapped around the zig-zag spacing tubes.

A protective wall in accordance with the invention is transferred to the place of use in the Antarctic seas where tabular icebergs are found, folded and wound around a floating storage and handling drum which is maintained upright on one of its sides by ballasting, the suspension cables being provisionally secured to the side that is above the water, and is unwound from the drum by means of a tug, to which the side of the wall is attached, the drum being held in place by another tug and the protective wall being kept afloat by a string of floats, and the ends of the suspension cables, provisionally secured to the side of the drum that is above the water, and then to the line of floats are transferred to the substantially horizontal upper surface of the tabular iceberg, before being gradually let out for the partial submersion of the protective wall parallel to the vertical side face of the tabular iceberg. Conversely, a protective wall in accordance with the invention can be recovered after the iceberg has been used, off the coast of a dry tropical zone. For this purpose, the suspension cables are reeled in so as to fold up the protective wall concertina-wise before winding it around a floating storage and handling drum.

The invention will now be described in more detail and by way of example only, with reference to the accompanying drawing, in which:

FIG. 6 is a front view of the vertical protective wall shown in FIG. 4;

FIG. 7 is a cross-section through the vertical protective wall shown in FIG. 4, on the line C;

Figure 1:
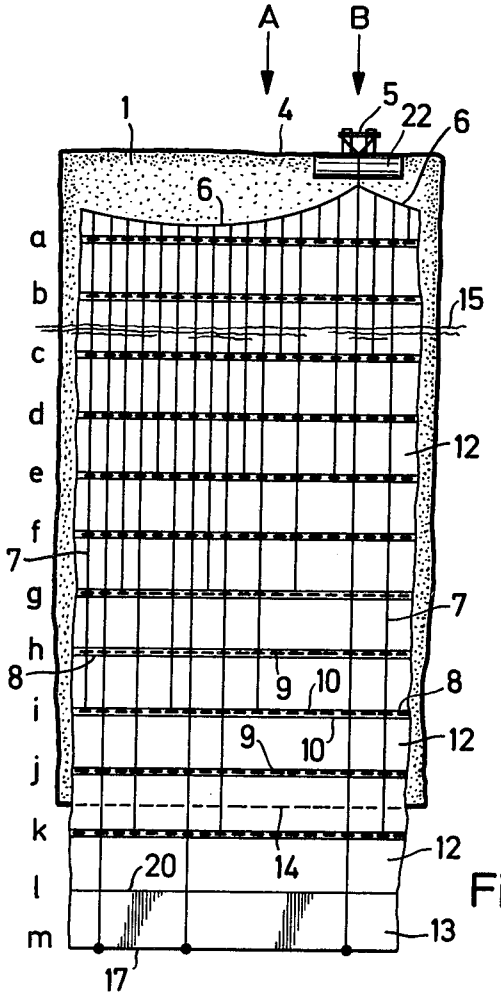
FIG. 1 is a partial view of a vertical side face of a tabular iceberg protected by a vertical protective wall in accordance with the invention.

FIG. 1 is a partial cross-section through a vertical face of a tabular iceberg (1) which is protected by a vertical protective wall (2) in accordance with the invention, enclosing a vertical layer of water (3). On the substantially horizontal upper surface (4) of the tabular iceberg (1) are anchoring points (5) which support the vertical protective wall (2) by means of retaining cables (6) which are substantially horizontal and have the form of a catenary curve. Vertical suspension cables (7) are secured to these retaining cables (6) at regular intervals. The upper end of each suspension cable (7) is secured to the retaining cables (6), and its lower end to elbows (8) of zig-zag spacing tubes (9). These are inserted in connecting strips (10) fixed to the sides (11) of vertical woven or non-woven panels (12). At the bottom of the protective wall (2) is suspended a ballast (13) which projects beyond the lower substantially horizontal surface (14) of the tabular iceberg (1). The protective wall (2) is partially submerged and provides at least one vertical layer of calm water (3) between the protective wall (2) and the vertical face (16) of the tabular iceberg (1). On the seaward side (18) of the protective wall (2), the wave movement around the mean level (15) of the sea (18) and solar radiation call for a protective screen extending over virtually the whole vertical face (16) of the tabular iceberg (1).

Figure 3:
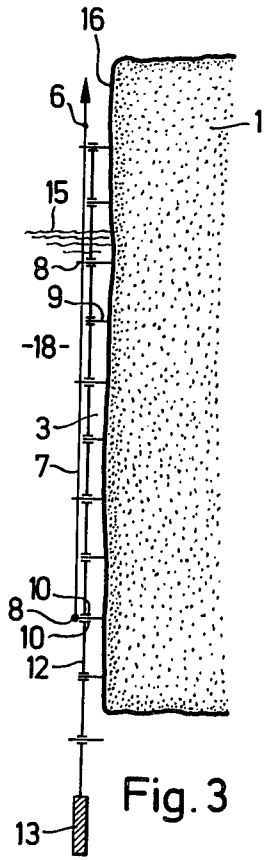
FIG. 3 is a partial cross-section through the tabular iceberg shown in FIG. 1, on the line A.
Figure 2:
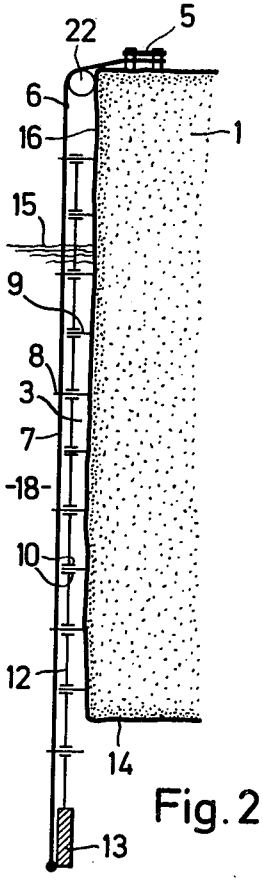
FIG. 2 is a partial cross-section through the tabular iceberg shown in FIG. 1, on the line B.

FIGS. 1, 2 and 3 show the method of attaching the vertical suspension cables (7) to the elbows (8) of the zig-zag spacing tubes (9), inserted in the connecting strips (10) fixed to the sides (11) of the vertical woven or non-woven panels (12). It will be noted that only every alternate tube is attached to a vertical suspension cable (7), i.e. (if letters are allocated to successive tubes) tubes a, c, e, g, i, k, etc. The lower edge (17) of the ballast (13) corresponding to the letter m, is also joined to vertical suspension cables (7). FIG. 2 shows a suspension cable (7) attached to an anchoring point (5) situated on the substantially horizontal upper surface (4) of the tabular iceberg (1), and to the lower edge (17) of the ballast (13), corresponding to letter m. In FIG. 3, a vertical suspension cable (7) is joined to the elbow (8) of the zig-zag spacing tube (9) corresponding to the letter i, and to the catenary retaining cable (6), which has a sag of about twenty meters. In no case does a suspension cable (7) pass through more than one in two of the elbows (8) in the zig-zag spacing tubes (9) starting from that to which it is attached. For example, the suspension cable (7) shown in FIG. 2 passes only through the elbows (8) of the zig-zag spacing tubes (9) corresponding to the letters a, c, e, g, i and k. The suspension cable (7) shown in FIG. 3 passes only through the elbows (8) in the zig-zag spacing tubes (9) corresponding to letters a, c, e and g. The suspension cables (7) always pass through the elbows (8) of the zig-zag spacing tube (9) corresponding to the letter a and located immediately beneath the substantially horizontal retaining cable (6). As an illustrative example, the suspension cables (7) may be at least 300 meters long and spaced by five to ten meters.

The protective wall (2) is manufactured ready folded using a technique disclosed elsewhere by the present applicants, and is transported to the place of use wound around a floating storage and handling drum which is ballasted so as to float on one end. It can therefore be maintained with its axis vertical by ballasting. To the end of the drum that is above the water are temporarily attached the ends of the support cables (7) which retain the elbows (8) of the zig-zag spacing tubes (9) and hold up the protective wall (2). The floating drum is retained in position by one tug while another tug unwinds the protective wall (2). The unwound protective wall (2) is kept on the surface of the sea (18) by a string of floats. The suspension cables (7) are progressively paid out, starting with the suspension cables (7) corresponding to the letter m, followed by the suspension cables (7) corresponding to the letter k, and so on. At the end of this procedure the protective wall (2) is suspended, partially submerged, in front of the vertical side face (16) of the tabular iceberg (1).

The protective wall (2) for the vertical side face (16) of the tabular iceberg (1) can be progressively drawn in when the iceberg is being rapidly melted off the coast of a dry region in the tropics. It is only necessary to decrease the lengths of the suspension cables (7) corresponding to the letter m until they are the same as those of the suspension cables (7) which correspond to the letter k. This causes the ballast (13) to be folded against the lower woven or non-woven panel (12), pivoting around the upper edge (20) of the ballast (13) corresponding to the letter l. The next stage, when the iceberg (1) is partially melted, is to simultaneously raise the lower panel (12) and the ballast (13) so that the zig-zag spacing tube (9) corresponding to the letter k rises to the level of the zig-zag spacing tube (9) initially corresponding to the letter l being raised to level j, and so on. This process is repeated until the entire protective wall (2) is folded up concertina fashion. It can then be rolled around a floating storage and handling drum for re-use on another tabular iceberg (1).

Figure 4:
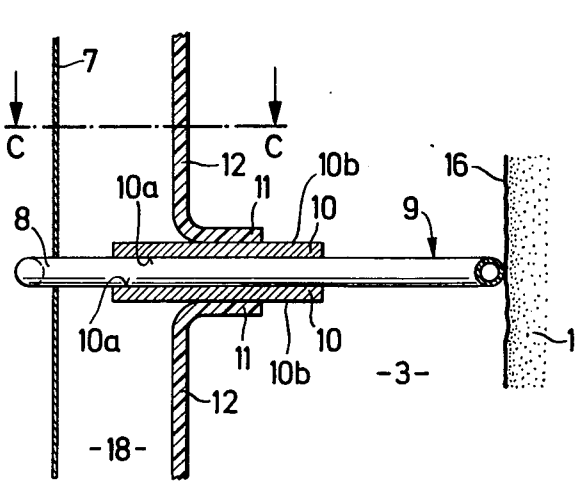
FIG. 4 is a partial view of the junction point of the panels forming a one-sheet vertical protective wall.

FIG. 4 is a detailed partial cross-section through a protective wall (2). FIGS. 6 and 7 are other views of the same protective wall (2). They show a zig-zag spacing tube (9) inserted between two connecting strips (10) onto which are fixed woven or non-woven panels (12) which form a sheet parallel with the vertical side face (16) of the tabular iceberg (1). Some of the elbows (8) of the zig-zag spacing tubes (9) are in contact with the vertical side face (16) of the tabular iceberg (1), because of its irregular shape. These elbows (8) of the zig-zag spacing tubes (9) keep the vertical panels (12) at a virtually constant distance from the vertical side face (16) of the tubular iceberg (1). This creates a vertical layer of calm sea-water (3) which thermally insulates the tabular iceberg (1) from the warm sea (18). The sides (11) of the vertical panels (12) are folded back horizontally and are secured by bonding, welding or stitching to the connecting strips (10) which are wrapped round the zig-zag spacing tubes (9), some of the elbows (8) of which are supported on the vertical side face (16) of the tabular iceberg (1). The connecting strips (10) are welded to one another on their inner faces (10*a*), which are partially in contact with the zig-zag spacing tubes (9), as shown in FIG. 6. Between two passages of the zig-zag spacing tubes (9) between the connecting strips (10), these strips are folded over with their inside faces (10*a*) in contact with one another, whilst the outside faces (10*b*) bear against the horizontally folded sides (11) of the vertical woven or non-woven panels (12). The assembly consisting of the connecting strips (10), the sides (11) of the vertical panels (12), and the zig-zag spacing tubes (9), is relatively rigid. Consequently, it is easy to keep it horizontal, even if only with the suspension cables (7) which are secured to some of the elbows (8) of the zig-zag spacing tubes (9) that are not in contact with the vertical side face (16) of the tabular iceberg (1). Additionally, as shown in FIGS. 1 to 3, the suspension cables (7) can pass through the loop formed by the elbows (8) of the zig-zag spacing tubes (9) that are not in contact with the vertical side face (16) of the iceberg (1) and the connecting strips (11) wrapped round the zig-zag spacing tubes (9). These suspension cables (7) attached to the retaining cables (6) are kept parallel with the vertical side face (16) of the iceberg. This is due to the zig-zag spacing tubes (9) and also because the retaining cables (6) are maintained at the desired distance from the vertical side face (16) of the iceberg (1) by gantries or beams (22) which act as spacers and are positioned on the substantially horizontal upper surface (4) of the iceberg (1), or on the vertical side face (16) of the tabular iceberg (1), near its upper surface.

Figure 5:
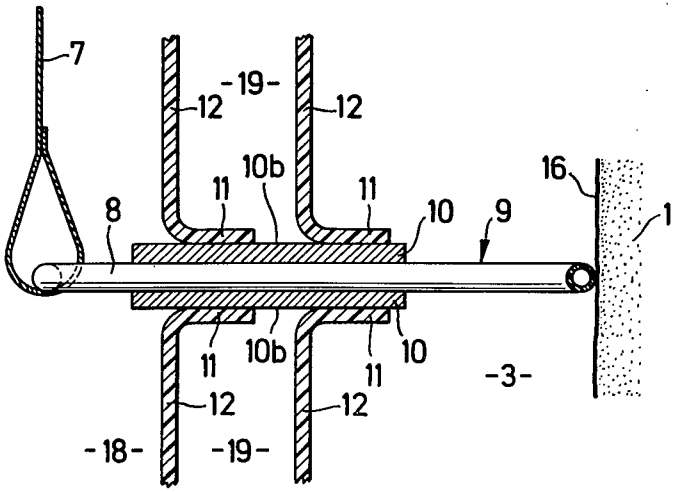
FIG. 5 shows an embodiment of the method of construction shown in FIG. 4 in which the protective wall has two sheets.

FIG. 5 represents a partial cross-section, on the same plane as FIG. 4, of a protective wall (2) with two sheets parallel to the vertical side face (16) of the iceberg (1). The two vertical, parallel sheets consist of vertical panels (12) enclosing between them a first vertical layer of water (19). Between the vertical side face (16) of the iceberg (1) and the protective wall (2) is a second vertical layer of water (3). The existence of two vertical layers of water (3) and (19) provides good thermal insulation of the iceberg (1), which is floating in the warm sea-water (18). The sides (11) of the vertical parallel panels (12) are secured to the outer faces (10*b*) of the connecting strips (10). The end of the suspension cable (7) is attached to the loop formed by the elbow (8) of the zig-zag spacing tube (9) that is not in contact with the vertical side face (16) of the iceberg (1).

Figure 8:
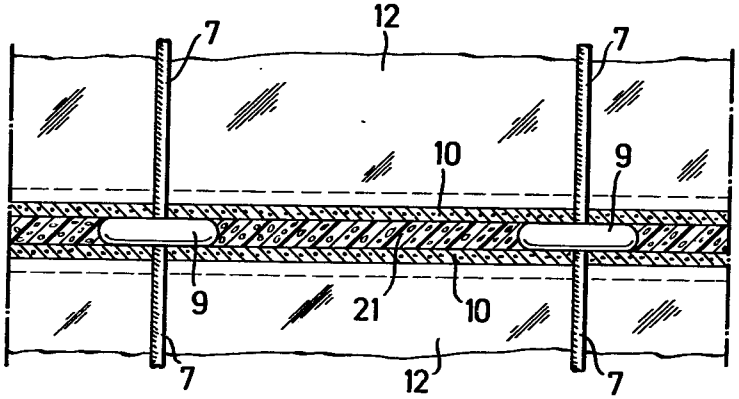
FIG. 8 is a cross-section of an embodiment of the wrapped zig-zag spacing tubes as shown in FIGS. 4 to 7.

FIG. 8 shows an embodiment of the wrapping of the zig-zag spacing tubes (9) as shown in FIGS. 4 to 7. Expanded foam buoyancy units (21) are located between the connecting strips (10) and the zig-zag spacing tubes (9). These compensate for the negative buoyancy of the protective wall (2), so that the upper vertical panels (12) are only subjected to the tension resulting from the ballast (13) positioned at the bottom of the protective wall (2).

Figure 9:
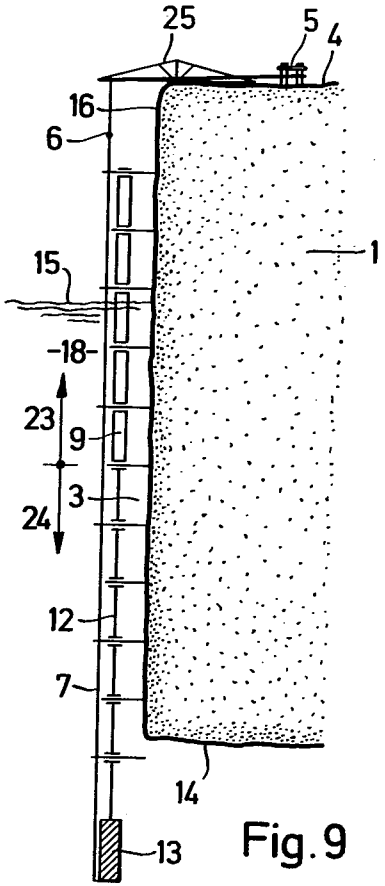
FIG. 9 is a partial cross-section through a tubular iceberg protected by a vertical protective wall incorporating two superimposed parts, comprising respectively two and one vertical panels.

It is quite possible to conceive of protective panels (2) with several sheets parallel to the vertical side face (16) of the iceberg (1), FIGS. 4 and 5 being easily generalisable. As shown in FIG. 9, it is possible to limit the construction costs of a protective wall (2) for tabular icebergs (1) by utilising a wall having two sheets in its top part (23), insulating the iceberg (1) from the warm sea-water (18), whereas the lower part (24), in the area of the ballast (13), has only one sheet. Each sheet consists of vertical woven or non-woven panels (12) with their sides (11) secured to horizontal connecting strips (10) wrapped around zig-zag spacing tubes (9), some of the elbows (8) of which are supported on the vertical side face (16) of the tabular iceberg (1). A gantry (25), positioned on the substantially horizontal upper surface (4) of the tabular iceberg (1) supports the protective wall (2) by means of suspension cables (7). A protective wall (2) incorporating two parts (23) and (24), positioned one above the other, provides thermal protection corresponding sufficiently accurately to the temperature gradient of the warm seas through which the tabular iceberg (1) passes as it is towed from the Antarctic to the dry regions bordering coastlines in the northern hemisphere.

The claims defining the invention are as follows:

1. A protective side wall for icebergs, which, when in position adjacent a side face of an iceberg, retains at least one vertical layer of calm water between itself and the iceberg; comprising panels displaced from the side face of the iceberg, the width of each panel being greater than its height; said panels being joined to one another and tensioned by ballast, being separately suspended from suspension cables attached to an upper surface of the iceberg, and including zig-zag spacing tubes inserted where said panels are joined to one another, some of the zig-zag tubes having elbows engaging the face of the iceberg, whereby the panels are maintained at a substantially constant distance from the side face of the iceberg.

2. A protective wall according to claim 1, comprising suspension cables joined directly or indirectly to the substantially horizontal upper surface of the tabular iceberg, and to some of the elbows of the zig-zag spacing tubes situated on the side of the protective wall opposite the vertical side face of the tabular iceberg.

3. A protective wall according to claim 1, wherein the sides of the panels located at equal distances from the ballast are secured to horizontal connecting strips at horizontal connections between the panels.

4. A protective wall according to claim 1, wherein every second horizontal row of zig-zag tubes is joined to suspension cables.

5. A protective wall according to claim 1, including flotation units positioned between the connections.

6. A protective side wall for icebergs, in accordance with claim 1, which when in position adjacent to an iceberg face, retains a plurality of vertical layers of calm water between its constituents and the side face of the iceberg.

7. A protective side wall as defined in claim 6 wherein a thermal protective vertical layer of calm water is formed between a face of the iceberg and a constituent of the protective side wall and a second, mechanical protective vertical layer of calm water is formed between constituents of the protective side wall.

* * * * *